United States Patent [19]

Forest et al.

[11] Patent Number: 4,763,161

[45] Date of Patent: Aug. 9, 1988

[54] COPIER OPERABLE IN AN INSERT MODE

[75] Inventors: Paul H. Forest; Thomas J. Murray, both of Rochester, N.Y.

[73] Assignee: Eastman Kodak Company, Rochester, N.Y.

[21] Appl. No.: 899,134

[22] Filed: Aug. 21, 1986

[51] Int. Cl.[4] ..... G03G 15/00

[52] U.S. Cl. ..... 355/14 SH

[58] Field of Search ..... 355/6, 3 SH, 14 SH

[56] References Cited

U.S. PATENT DOCUMENTS

| | | | |
|---|---|---|---|
| 4,248,528 | 2/1981 | Sahay | 355/14 R |
| 4,310,235 | 1/1982 | Lorenzo et al. | 355/6 |
| 4,350,434 | 9/1982 | Paulus et al. | 355/14 SH |
| 4,609,283 | 9/1986 | Murata et al. | 355/14 SH X |

*Primary Examiner*—Patrick R. Salce
*Assistant Examiner*—Marc S. Hoff
*Attorney, Agent, or Firm*—Milton S. Sales

[57] ABSTRACT

Apparatus circulates successive originals of a set to an exposure position and selectively produces images of an original at the exposure position. Copy sheets of either a first characteristic or a second characteristic are presented for receiving produced images. Keysheets are adapted to be interleaved into the original set at positions for designating individual documents of the set, the keysheets having indicia for identifying keysheet orientation in the set. The apparatus senses the presence and orientation of the keysheets and effects presenting means to supply a copy of sheet of the first characteristic if a keysheet is not sensed and a copy sheet of the second characteristic if a keysheet is sensed. Images of the designated individual original are either produced or not produced in accordance with the orientation of the keysheet.

5 Claims, 6 Drawing Sheets

COPIER OPERABLE IN AN INSERT MODE

BACKGROUND OF THE INVENTION

This invention relates to copier apparatus and more particularly to copier apparatus which copies designated originals in a set thereof on special copy sheet inserts.

DESCRIPTION OF THE PRIOR ART

In copying a set of originals, it may be desired to insert into the copy sheet supply one or more special copy sheets having a different characteristic, such as color or weight of stock. U.S. Pat. No. 4,350,434, issued Sept. 21, 1982, for "Electrophotographic Copying Machine," by R. Paulus et al, a copying machine is disclosed which has plural copy sheet supplies containing different types of sheets. A control panel includes a "copy normal paper " switch and a "copy special paper" switch to effect feeding of normal or special paper. The technique requires that the switches be set as each original is manually fed to a platen, is slow and requires constant operator intervention in actuating the various switches for each original.

With the advent of high-speed copiers, the manual operation of repeatedly placing originals on a copier platen and pressing a copy button has been superseded by automatic recirculating feeders. In one such feeder, disclosed in U.S. Pat. No. 4,248,528, issued Feb. 3, 1981, for "Copier With Document Sensing Control," patentee R. B. Sahay, it has been proposed to interleave preprinted, operator-marked control sheets in the original set to control the operation of the copier. The control sheets are fed together with the original documents past an optical scanner connected to the copier controller. The originals are copied in the manner instructed by the preceeding control sheets which may for example instruct the copier to copy selected originals on inserted copy sheets of colored or heavy card stock, transparency material, tabbed sheets, or the like. This technique for controlling a copier is disadvantageous in requiring complex operator marking of control sheets in order to effect one of a plurality of copy modes.

In commonly assigned U.S. patent application Ser. No. 819,579, filed Jan. 17, 1986 in the name of R. L. Bray as a continuation of application Ser. No. 565,934, filed Dec. 27, 1983, copier apparatus with a recirculating document feeder is disclosed having supply means for selectively supplying copy sheets of either first or second characteristics. Control means are operable in a setup mode for controlling the feeder to circulate originals one at a time under operator control. As each original is presented, the operator may designate individual originals to be copied on inserted copy sheets of the second characteristic. In a producing mode, the control means causes (1) the feeder to circulate originals to the exposure position for producing sequential images of the originals and (2) the supply means to supply to the producing means copy sheets of the first characteristic to receive images thereon of nondesignated originals and copy sheets of said second characteristic to receive thereon images of designated originals. While the system disclosed by Bray is an excellent and reliable method for inserting special copy sheets for designated originals, it does require that the original set be circulated through the machine one time before the producing operation so that the designations can be made.

SUMMARY OF THE INVENTION

In accordance with the present invention, copier apparatus includes means for circulating successive originals of a set to an exposure position and means for selectively producing images of an original at the exposure position. Means are provided for selectively presenting copy sheets of either a first characteristic or a second characteristic to an image receiving position for receiving images from the producing means. Keysheets may be interleaved into the original set at positions for designating individual documents of the set, the keysheets having indicia means for identifying keysheet orientation in the set. The apparatus senses the presence and orientation of a keysheet and controls the presenting means to supply a copy sheet of the first characteristic if a keysheet is not sensed and a copy sheet of the second characteristic if a keysheet is sensed. The producing means is controlled to either produce or not produce images of the designated individual original in accordance with the orientation of the keysheet.

In accordance with another feature of the present invention, a keysheet is adapted to be interleaved into a set of originals at predetermined positions for use in copier apparatus having an exposure position, means for repeatedly circulating successive originals to the exposure position, means for selectively producing images of an original at the exposure position, and at least one operator selectable function which, if selected, is operable in more than one mode. The keysheet comprises indicia means for identifying keysheet orientation in the original set so as, by its presence or absence, to control the selection of the function and by its orientation, to control the mode of operation when the keysheet is used with such copier apparatus.

In accordance with yet another feature of the present invention, copier apparatus includes an exposure position, means for repeatedly circulating successive originals of an original set to the exposure position, and (3) means for selectively adjusting a predetermined copier operation for a designated original. Keysheets may be interleaved into the original set at positions for designating individual originals, the keysheets having indicia means for identifying keysheet orientation in the set. Means are provided for sensing the presence and orientation of a keysheet. Other means, responsive to said sensing means, control adjustment of said predetermined copier operation, for individual originals designated thereby, in accordance with the orientation of a sensed keysheet.

In a preferred embodiment of the present invention, keysheets are interleaved in the original set immediately below the designated original. The keysheet has a characteristic hole placed off center. Situating the keysheet with the hole closest to one say the upper right hand, corner of the original set produce a printed insert and the customer will be charged for the insert. Situating the keysheet with the hole closest to another corner of the original set will produce a non-printed insert, and the customer will not be charged.

Further in accordance with the preferred embodiment, productivity is increased in the insert mode by diverting the keysheets from the original set to an exit bin after one complete booklet has been copied. This will enable the operator to view the first booklet to determine if the keysheets were placed in the correct location and orientation. If the first booklet is unacceptable, the originals may be removed from the feeder tray and the keysheets relocated.

The invention and its objects and advantages will become more apparent in the detailed description of the preferred embodiments presented below.

BRIEF DESCRIPTION OF THE DRAWINGS

In the detailed description of the preferred embodiment of the invention, reference is made to the accompanying drawings, like numbers indicating like elements, in which.

DESCRIPTION OF THE PREFERRED EMBODIMENT

To assist in understanding the present invention, it will be useful to consider an electrophotographic copier having a logic and control unit (LCU), and operator control panel, and a circulating original feeder. It will be noted that although the invention is suitable for use with a circulating feeder it may also be used with other types of feeders.

Figure 1:
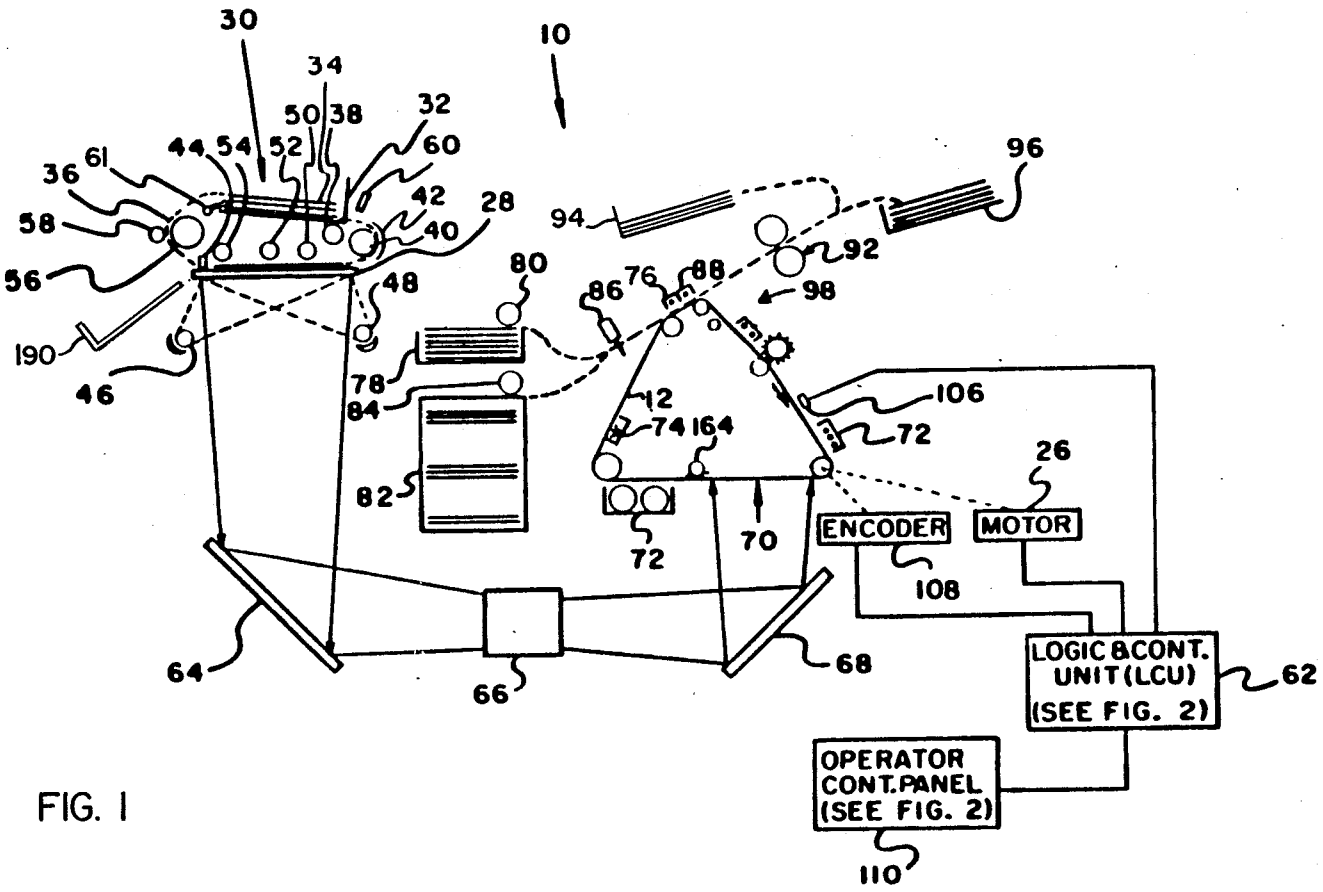
FIG. 1 is a schematic representation of electrographic copier apparatus according to the present invention.

Referring now to FIG. 1, there is shown an electrographic copier 10 having a photoconductive belt 12 trained about a set of rollers. Belt 12 is moved in a clockwise direction, as illustrated, by means of a motor 26. Copier 10 has an exposure position including a platen 28.

A circulating feeder 30 has a receiving position such as a tray 32 for receiving a set of originals 34 and for sequentially circulating the originals from the bottom of tray 32 to exposure platen 28. This is effected by means of a feed roller 38 which feeds the bottom most original in tray 32 between a guide roller 40 and a guide 42 onto platen 28, where the original is stopped by a gate 44. A more detailed disclosure of the operation and structure of feeder 30 is disclosed in commonly assigned U.S. Pat. No. 4,099,860.

After the original is exposed by a pair of flash lamps 46 and 48, gate 44 is moved out of path 36, and rollers 50, 52, 54, 56 and 58 move original 34 back to the top of the original set in tray 32. As will be described in greater detail later, as an original 34 moves along path 36 away from tray 32, a detector 60 generates a count signal which is applied to LCU 62. A set count finger 61 is also provided for resting on the top of a set and for indicating when a set of originals has been circulated by feeder 30.

When an original has been flash illuminated by flash lamps 46 and 48, an image is produced which is projected by a mirror 64, a lens 66, and a mirror 68 onto belt 12 at an exposure station 70. A charging station sensitizes belt 12 in advance of exposure station 70 by applying an electrostatic charge thereon. At exposure station 70, the projected light image dissipates the electrostatic charge at the exposed areas of the photoconductor to form a latent electrostatic image corresponding to the image of the original.

The latent electrostatic image is developed with toner at a magnetic brush developing station 72. The toner image is subjected to radiation by a post-development erase lamp 74 to reduce the electrical stress on photoconductive belt 12 and to reduce the attraction between the toner image and belt 12.

As the toner image approaches a transfer station 76, a copy sheet is fed from either a supply 78 by feed roller 80 or from a supply 82 by feed roller 84 to a registration mechanism 86. At a proper time, registration mechanism 86 releases the copy sheet so that it is moved into registration with the toner image on belt 12 in advance of transfer station 76 and detack station. The copy sheet is then transported to a fusing station 92 and to either an upper output tray 94 or a side output tray 96. A cleaning station 98 removes any residual toner from belt 12 so that is ready for another electrophotographic cycle.

Figure 2:
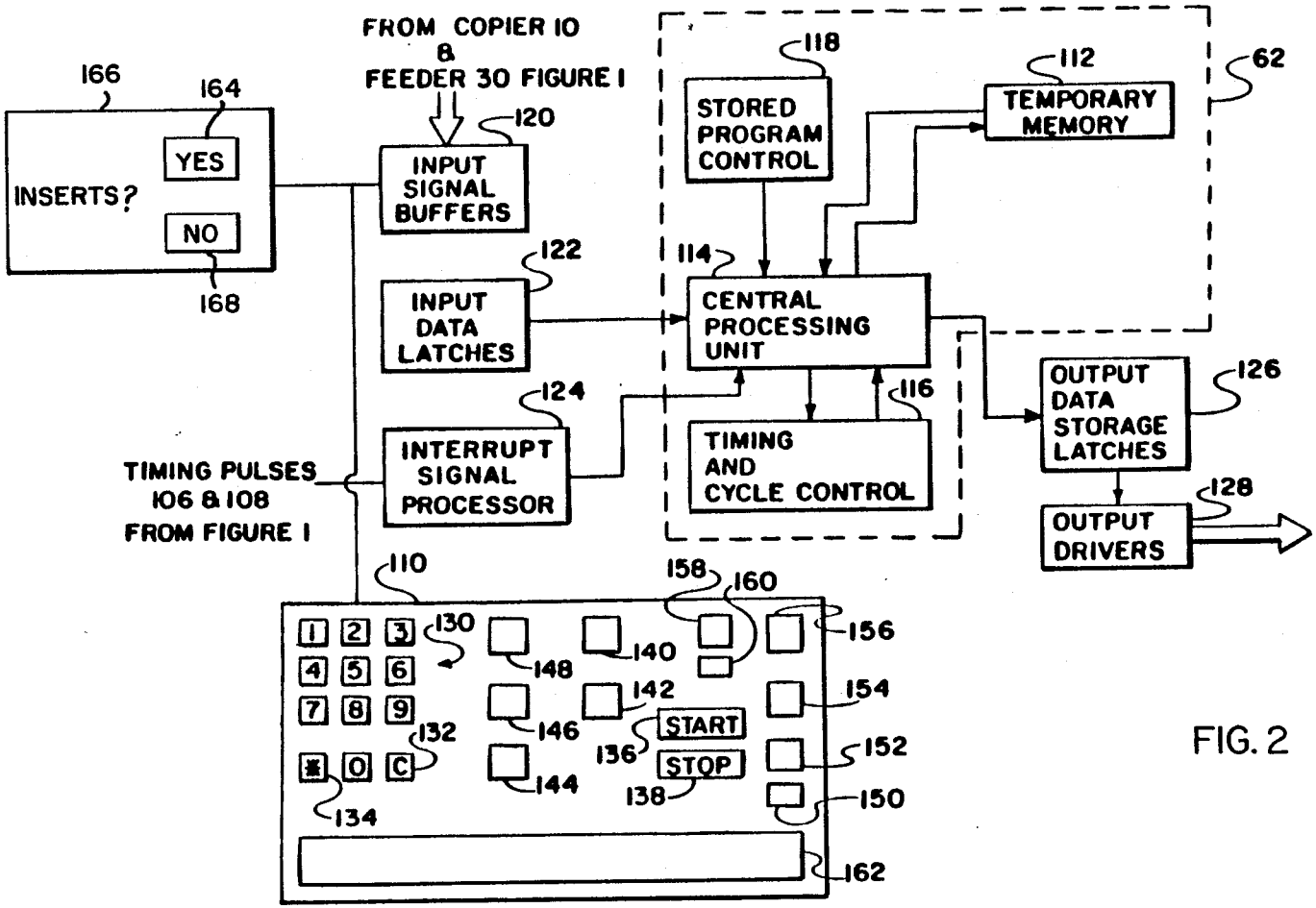
FIG. 2 is a more detailed block diagram of a logic and control unit and an operator control panel in the appratus of FIG. 1.

Referring now to FIG. 2, there is shown in greater detail a block diagram of LCU 62 to which is connected an operator control panel 110. LCU 62 has a programmable computer such as a microprocessor which has a stored program responsive to input signals for sequentially actuating the various instrumentalities of copier 10 and feeder 30 as well as for controlling the operation of many other functions of copier 10 (as disclosed in greater detail in U.S. Pat. No. 3,914,047).

LCU 62 includes a temporary data storage memory 112, a central processing unit 114, a timing and cycle control unit 116, and a stored program control unit 118. Data input and output is performed sequentially under program control. Input data is applied to LCU 62 either through input signal buffers 120 to input data latches 122 or through an interrupt signal processor 124. The input signals are derived from various switches such as provided on operator control panel 110, from timing pulses such as from detector 106 and encoder 108, and from various analog to digital converters. The output data and control signals are applied to an output data storage latches 126 which provide inputs to suitable output drivers 128 which are connected to various copier and feeder instrumentalities.

Operator control panel 110 includes a plurality of operator actuatable switches (buttons), only some of which are shown, and a display 162. For example, a numerical keyboard 130 includes ten buttons for "0" and each of the numbers "1"–"9" inclusive. A "C" button 132 is used to cancel or clear the previous instructions fed in from panel 110. Star "*" button 134 is used in accordance with an operating mode, herein called the "slip sheet" mode, for indicating designated originals which are to be copied on copy sheets of a different characteristic than other originals. That mode is described in detail in aforementioned U.S. patent application Ser. No. 819,579, filed Jan. 17, 1986. Selecting a stop button 138 terminates operation of the copier.

Copier 10 and feeder 30 may be operated in either a non-collate or collate mode. If the collate mode is not desired, then button 140 is depressed and if the collate mode is desired, button 142 is depressed. In the non-collate mode, a set of originals placed in tray 32 of feeder 30 is fed individually to copier platen 28 where the copier makes the number of copies requested by the operator for each original placed on platen 28 before making copies of the next original. On the other hand, in the collate mode, each original in a set is sequentially copied and after the set of originals has been copied once, the set is recycled until the number of copies requested is completed. Thus, in the non-collate mode, the output of the copier are sets of uncollated copies which must either be collated manually or collated by a sorter. On the other hand, when operating in the collate mode, a set of collated copies is produced.

The originals which are fed to exposure platen 28 may have images on two sides (duplex) or may have images only on one side (simplex). Similarly, the copies which are produced by copier 10 may have images on either one or two sides of the copy. Thus, if duplex output is not desired, then "no" button 144 is actuated. If duplex output is desired, then the operator would either depress button 146 if one-sided originals were placed in feeder 30 or button 148 if two-sided originals were placed in feeder 30.

Copier 10 may also be operated in a cover insertion mode in which special copy sheets may be provided from a supply to the front and/or back of a copy set. If covers are not requested, then the operator would depress button 150. Buttons 152, 154, and 156 respectively indicate to the copier whether covers are requested on the front, back or both front and back of a copy set. Button 158 is actuated to effect output of copies to side tray 96, while button 160 is actuated to effect output of copies to top tray 94.

Other buttons not shown may also be provided on operator control panel 110 to regulate the exposure of a copy, to select reduction or enlargement of an original, etc. Control panel 110 also includes a display 162 which shows messages to indicating to the operator in what mode the copier is operating, what action should be taken next, where jams may be located, etc.

Copier 10 can be operated in either an insert or non-insert mode. If the insert mode is desired, a "YES" button 164 on a Special Functions Panel 166 is depressed; and if the non-insert mode is desired, a "NO" button 168 is depressed. When "YES" button 164 is depressed, copier 10 enters a mode, herein called the "insert mode", in which originals which have been designated in a manner to be hereinafter explained are copied on copy sheets from supply 78 while non-designated originals are copied on copy sheets from supply 82.

Figure 3:
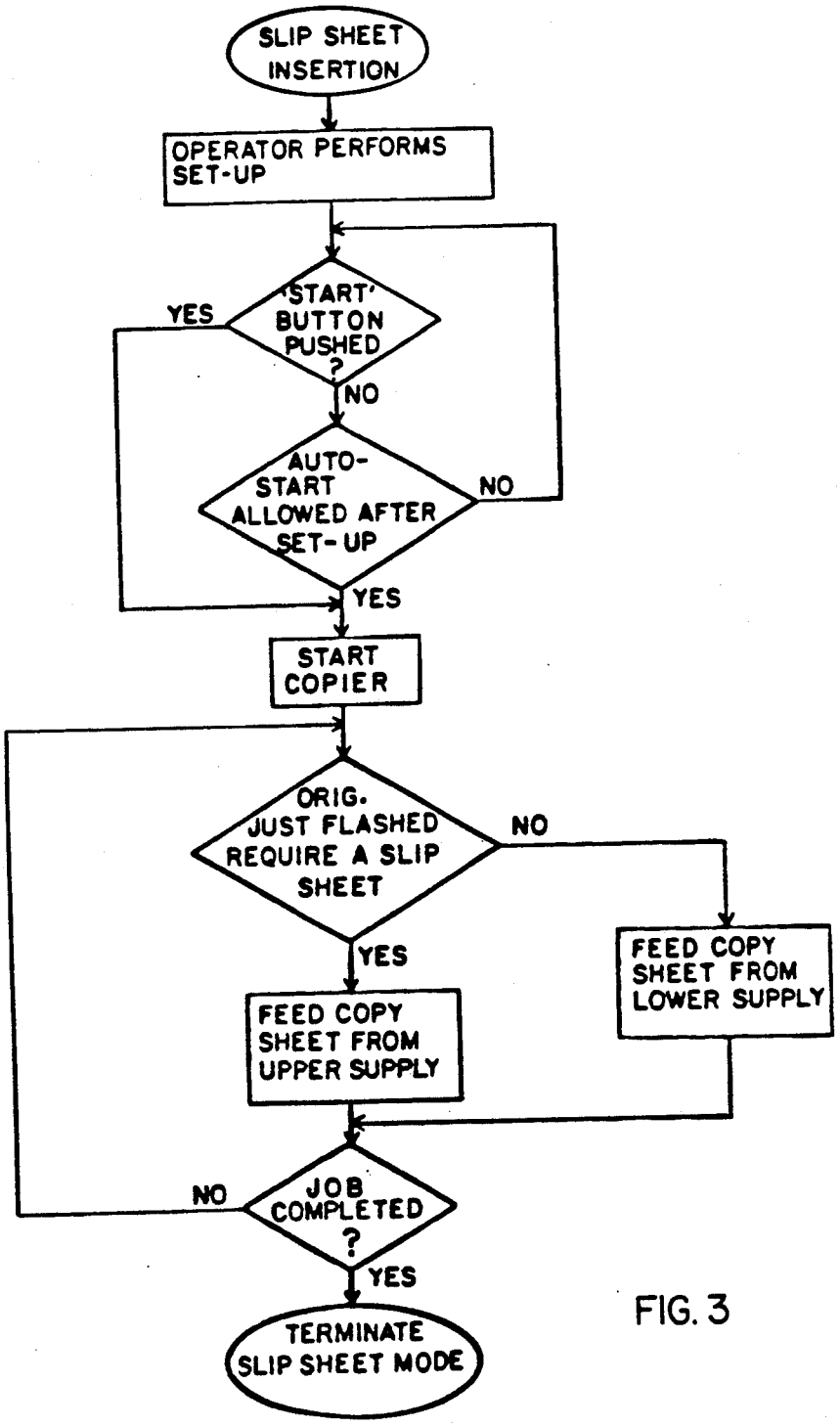
FIG. 3 is a producing mode flow chart of the operation of the apparatus of FIG. 1.

Referring now to FIG. 3, there will be described the operation of Copier 10 in the "insert" mode according to the present invention in which designated originals are copied on special copy sheets. In this mode, non-designated originals in a set which has been placed in feeder 30 are copied on copy sheets of a first characteristic loaded into supply 82. Sheets from supply 82 may, for example, be sheets having a white color and of typewriter weight such as 16-lb. bond paper. Designated originals are copied on copy sheets of a second characteristic which are loaded in upper supply 78. Sheets in supply 78 may, for example, have a different color such as yellow, pink, or the like, and/or may be of a different weight such as 32-lb. bond paper. In a manner to be explained, an image of the designated original may not be produced on the inserted copy sheet, and thus a "blank" copy sheet is produced (although the copy sheet itself may have been pre-printed and thus not literally be blank).

In the first step of the setup procedure, the operator of copier 10 selects the various modes in which copier 10 is to be operated by depressing various switches on operator control panel 110. Thus, the operator indicates whether two-sided copy is to be produced, indicates whether the feeder is operated in a collate or non-collate mode, and indicates whether covers are to be inserted and if so, where. For purposed of illustration, it is assumed that single-sided or simplex copies are to be made from a set of single-sided originals that only one copy of the set of originals is to be made, that the set is to be copied in the collate mode and that covers are to be inserted both at the front and at the back of the copy set. In the configuration of the apparatus of FIG. 1, it is assumed that the covers will be of the same copy sheet characteristic as the insert sheets for designated originals. However, it will be understood that separate supplies other than 78 and 82 may be provided for both cover sheets or for individual cover sheets. Thus, the operator in making the mode selection presses button 144 to indicate that two-sided copy is not requested, pressed button 142 to indicate that feeder 30 is to operate in the collate mode, presses button 156 to indicate that covers are to be provided on both the back and front of the copy set and presses button 160 to indicate that the copy set is to be delivered to output tray 94.

The next step is for the operator to designate originals for which inserts are to be made and whether those inserts will be printed or blank. The manner of designation will be explained below. Next, the operator places the set of originals 34 in tray 32 of feeder 30 so that the pages are facing up with the last original on the bottom and the first original on top. Set count finger 62 is initially on top of the first original 34. The operator selected switches on control panel 110 during the mode selection step stores a series of instructions in temporary memory 112 of LCU 62.

The operator now indicates to the copier that the insert mode has been selected by depressing "YES" button 164. The operator enters the number of copies requested by depressing the 1 button.

Referring now to FIG. 3, after the setup procedure has been completed, the copier is prepared to operate in the production mode. Thus, the operator pushes start button 136 to initiate copying. In either event, copier 10 is started and feeder 30 sequentially circulates originals from tray 32 to exposure platen 28. At each circulation of an original the copy count detector 60 sends a signal to LCU 62 which determines, in a manner to be disclosed below, whether or not the original just flashed requires an insert sheet (i.e., a copy sheet of the second characteristic), and if so, whether the insert is to be printed or blank. If neither, a copy sheet is fed from lower supply 78. If an insert sheet is required, then a copy sheet is fed from upper supply 78. Since in this illustration the operator has selected cover sheet insertion, a copy sheet from supply 78 is fed as the back cover of the copy set when the lower most original is circulated to exposure platen 28. Whether or not this cover has an image or is blank is a function of whether the bottom original has an image or is blank. The originals are circulated sequentially one at a time from receiving tray 32 to exposure platen 28 and back to the top of receiving tray 32 with copy sheets from supply 78 being provided for designated originals and copy sheets from supply 82 being provided for non-designated originals. When the upper most original is fed onto platen 28, set count finger 61 indicates to LCU 62 that the entire set of originals has been circulated and that the original just flashed is the first original in the set. This is to be copied as a front cover on a sheet fed from supply 78. Since only one copy has been requested, the copier job is completed, the slip sheet mode is terminated and the copy process ends.

INSERT DESIGNATION

Figure 4:
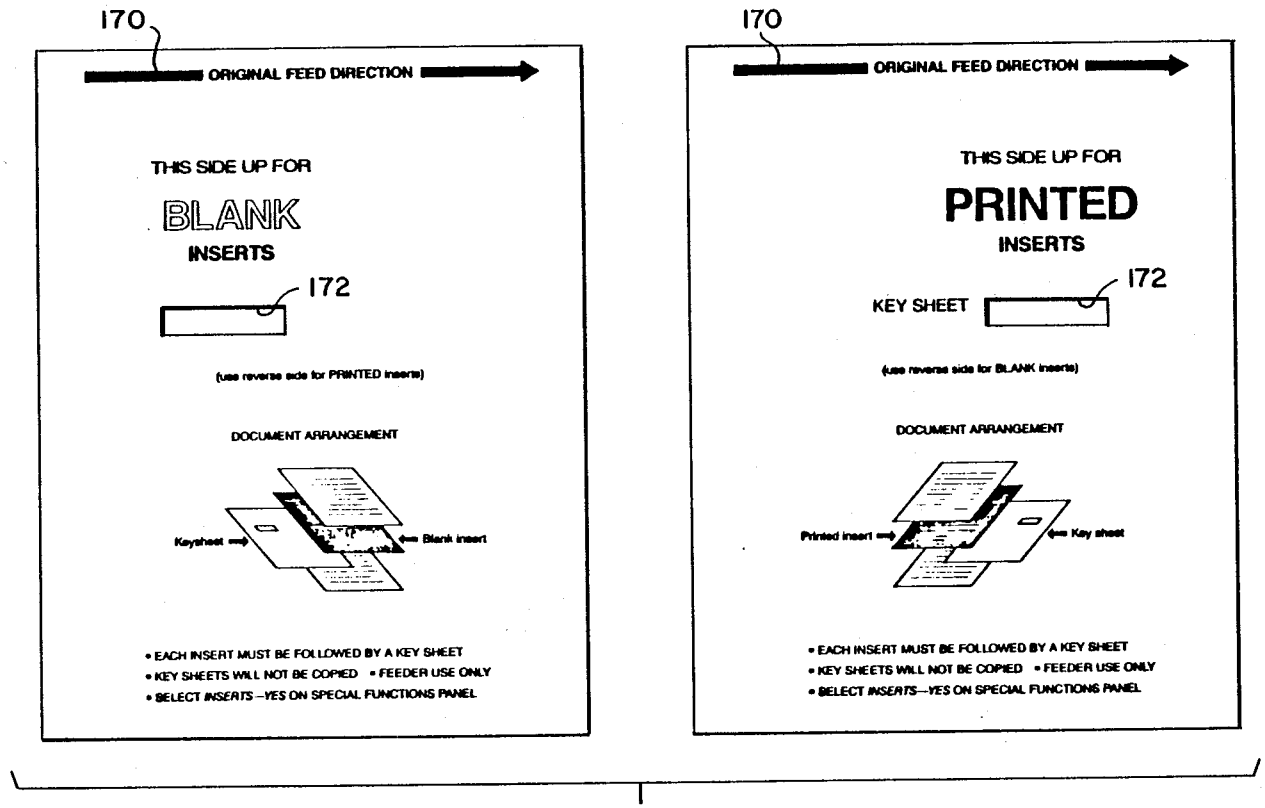
FIG. 4 is a front and back view of a keysheet usable with the apparatus of FIG. 1.

In accordance with the present invention, keysheets are utilized to designate (1) particular originals for which insert copy sheets are to be provided and (2) whether or not the inserts are to be printed or left blank. FIG. 4 shows both sides of a preferred embodiment keysheet 170, which is a conventional sheet of paper or other suitable material of standard size (i.e., the same size as the originals so that it can be transported through feeder 30). In addition to printed messages which assist the operator in using keysheet 170, the keysheet has a machine readable indicia by which copier 10 can detect the orientation of the keysheet in the original set. In the preferred embodiment, the indicia has a characteristic hole 172 placed off center to the major axis of the keysheet and aligned with copy count detector 60.

Figure 5:
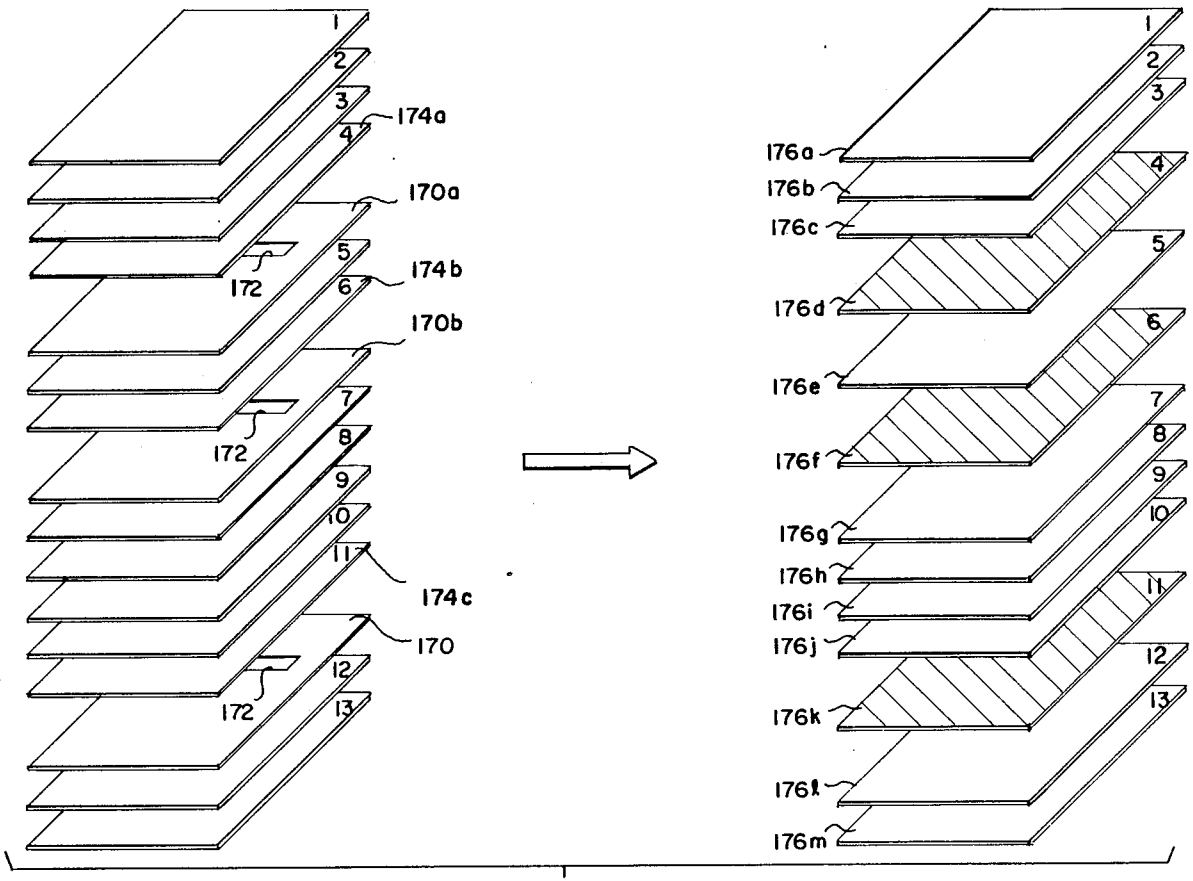
FIG. 5 is a schematic representation of an original set with keysheets and a collated booklet.

The set up operation will be described with reference to FIG. 5 for a collate copy mode. In the illustrated example, it is assumed that the operator has a thirteen page original set to copy, and that the operator desires to designate the fourth, sixth and eleventh pages to be copied onto copy sheets from supply 78 (FIG. 1) while the remainder of the originals are reproduced onto copy sheets from supply 82.

With this in mind, the operator has placed keysheets 170*a*, 170*b* and 170*c* into the original set below designated originals 174*a*, 174*b* and 174*c*. The keysheets have been oriented so that each has its characteristic hole 172 to the right of the sheet's major axis. Given this setup, copies 176*a* to 176*m* of the originals will be produced on copy sheets from supply 82, except that the fourth, sixth and eleventh pages (i.e., copies 176*c*, 176*f* and 176*k*) will have been produced on copy sheets from supply 78. Whatever image is on the upper surface of the originals will have been reproduced onto the copy sheets including the sheets inserted from supply 78. Of course, no copy sheets will have been provided for keysheets 170*a* to 170*c*.

Copier apparatus for detecting the presence and orientation of the keysheets includes copy count detector 60 (FIG. 1) which is aligned with characteristic hole 172. Detector 60 sends a signal to LCU 62 which determines whether or not the next original to be flashed requires an insert sheet from supply 78 and if so, whether or not the insert is to be printed or blank.

Figure 6:
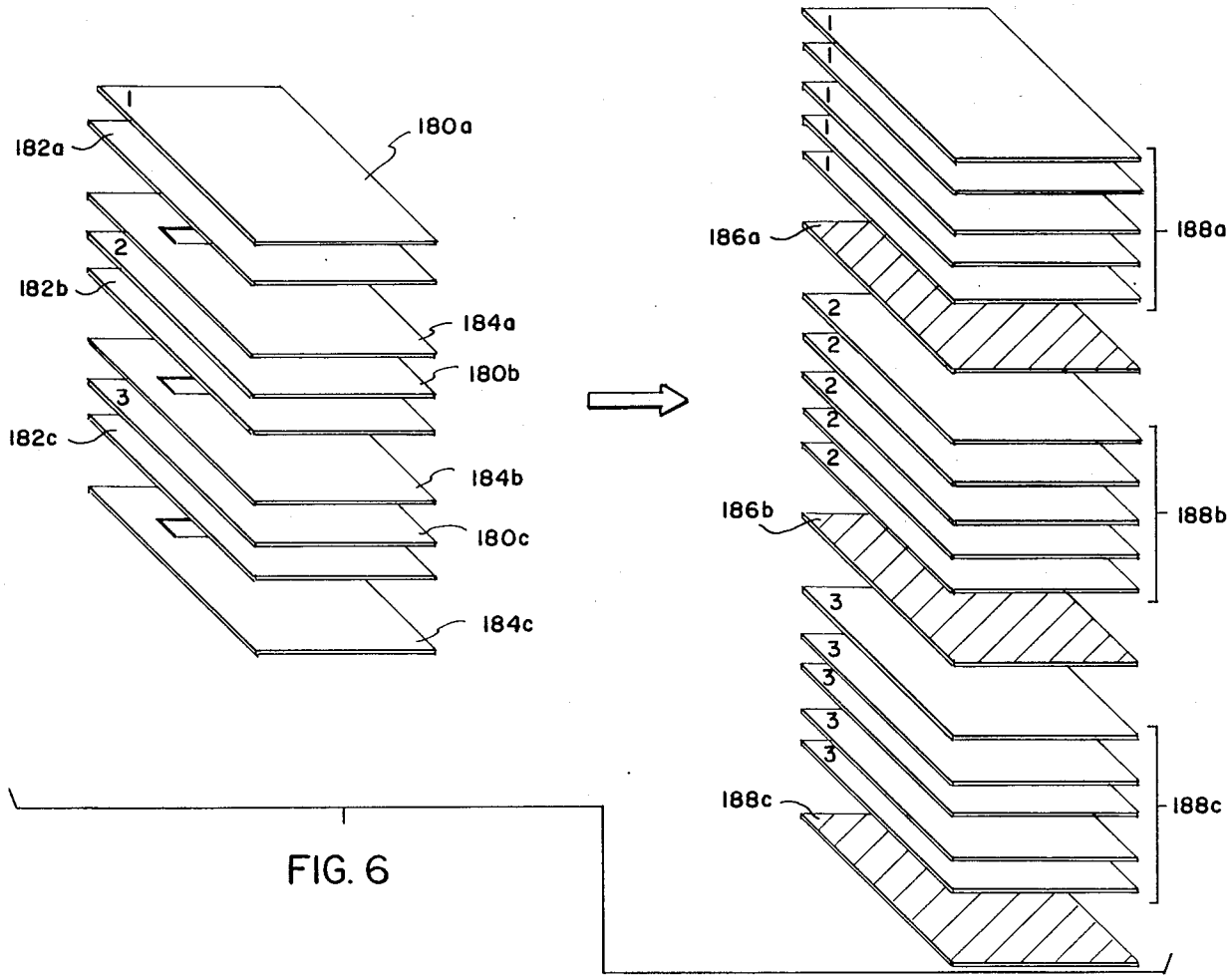
FIG. 6 is a view similar to FIG. 5 with a non-collated booklet.

FIG. 6 shows a set up configuration for a three-page original set to be run from copy sheet supply 82 in a non-collate mode with dividers from supply 78 inserted between copies of each original. Each original 180*a*, 180*b* and 180*c* is followed by a separator sheet 182*a*, 182*b*, and 182*c*, respectively. Each separator sheet is itself followed by a keysheet 184*a*, 184*b* and 184*c* oriented such that the separator sheets will not be reproduced (i.e., the characteristic hole is to the left of the major axis).

After the operator sets the control panel for 5 copies, non-collated, the production run begins. Keysheet 184*c* is fed from the bottom of the stack and sets the LCU to (1) supply a single copy from supply 78 for separator 182*c* and (2) erase any electrostatic image on belt 12 associated with separator 182*c*. As a result, a blank separator 186*c* will be produced on a copy sheet from supply 78. Next, original 180*c* is reproduced five times to produce five copies 188*c*. In sequence, separator 186*b* copies 188*b*, separator 186*a* and copies 188*a* are produced in similar manner. Separators 186*a*–186*c* are preferably of a color distinct from copies 188*a*–188*c* so that the operator can easily locate them in the stack.

The above description is for making a single set of copies. Often, an operator will want to make several sets of collated copies. In order to increase the productivity of the copier, it is desirable to remove the keysheets from the original set after one set of copies has been made and LCU 62 has been set (i.e, after the first copy run has been effected). On the other hand, it would be desirable to leave the keysheets in the original set until after the operator has had an opportunity to inspect the first copy set to make sure that the keysheets have been properly positioned.

To that effect, copier LCU 62 in accordance with the preferred embodiment is programmed to leave the slip sheets in the original set for the first copying cycle, during which times the position and orientation of the keysheets are stored in temporary memory 112. The originals and interleaved keysheets are returned to tray 32, and the copy operation is interrupted while the operator inspects the copies. To complete the copy operation, the operator depresses "start" button 136 after rearranging the keysheets if necessary. As the next copy set is being produced, feeder 30 diverts the keysheets to a positioner exit tray 190 (FIG. 1) similar to that shown in commonly assigned U.S. Pat. No. 4,176,945 which issued Dec. 4, 1979. During the production of subsequent copy sets, there is a saving of time which would have been required to feed the keysheets.

The invention has been described in detail with particular reference to a preferred embodiment thereof, but it will be understood that variations and modifications can be effected within the spirit and scope of the invention.

We claim:

1. In a copier apparatus including (1) an exposure position, (2) means for repeatedly circulating successive originals of an original set to the exposure position, (3) means for selectively producing images of an original at the exposure position, and (4) means for selectively presenting copy sheets of either a first characteristic or a second characteristic to an image receiving position for receiving images from the producing means, the improvement for use with keysheets adapted to be interleaved into the original set at positions for designating individual originals, said keysheets having indicia means for identifying keysheet orientation in the set wherein said copier further comprises:

means for sensing the presence and orientation of a keysheet;

means, responsive to said sensing means, for controlling the presenting means to supply a copy sheet of the first characteristic if a keysheet is not sensed and a copy sheet of the second characteristic if a keysheet is sensed; and means, responsive to said sensing means, for controlling the producing means to either produce or not produce images of the designated individual original in accordance with the orientation of the keysheet.

2. In copier apparatus including (1) an exposure position, (2) means for repeatedly circulating successive originals of an original set to the exposure position, (3) means for selectively producing images of an original at the exposure position, and (4) means for selectively presenting copy sheets of either a first characteristic or a second characteristic to an image receiving position for receiving images from the producing means; the improvement for use with keysheets adapted to be interleaved into the original set at positions for designating individual originals, said keysheets having indicia means for identifying keysheet orientation in the set wherein said copier further comprises:

means for sensing the presence and orientation of a keysheet;

means, responsive to said sensing means, for controlling the presenting means to supply a copy sheet of the first characteristic if a keysheet is not sensed and a copy sheet of the second characteristic if a keysheet is sensed; and means, responsive to said sensing means, for controlling the producing means to either produce or not produce images of the designated individual original in accordance with the orientation of the keysheet; and means for ejecting said keysheets from the original set during a circulation of the original set subsequent to the first such circulation.

3. The improvement as defined in claim 2 further comprising memory means for storing the designation information of the keysheets during the first original set circulation for use during subsequent circulations.

4. A keysheet adapted to be interleaved into a set of originals at predetermined positions for use in copier apparatus having (1) an exposure position, (2) means for repeatedly circulating successive originals to the exposure position, (3) means for selectively producing images of an original at the exposure position, and (4) at least one operator selectable function which, if selected, is operable in more than one mode; said keysheet comprising indicia means for identifying keysheet orientation in the original set so as by its presence or absence to control the selection of the function, and by its orientation, to control the mode of operation when the key sheet is used with such copier apparatus.

5. In copier apparatus including (1) an exposure position, (2) means for repeatedly circulating successive originals of an original set to the exposure position, and (3) means for selectively adjusting a predetermined copier operation for a designated original; the improvement for use with keysheets adapted to be interleaved into the original set at positions for designating individual originals, said keysheets having indicia means for identifying keysheet orientation in the set; wherein said copier further comprises:

means for sensing the presence and orientation of a keysheet;

means, responsive to said sensing means, for controlling adjustment of said predetermined copier operation, for individual originals designated thereby, in accordance with the orientation of a sensed keysheet.

* * * * *